US005933995A

United States Patent [19]

Gorbach

[11] Patent Number: 5,933,995

[45] Date of Patent: Aug. 10, 1999

[54] FOLDING PRODUCT TAG

[75] Inventor: Peter J. Gorbach, Naperville, Ill.

[73] Assignee: Ekco Housewares, Inc., Franklin Park, Ill.

[21] Appl. No.: 08/804,656

[22] Filed: Feb. 25, 1997

[51] Int. Cl.[6] ..... G09F 3/10

[52] U.S. Cl. ..... 40/672; 40/299.01; 206/806

[58] Field of Search ..... 40/124.09, 299.01, 40/6, 306, 316, 317, 334, 539, 640, 665, 672; 206/207, 349, 553, 806

[56] References Cited

U.S. PATENT DOCUMENTS

| | | | |
|---|---|---|---|
| 877,347 | 1/1908 | Lazar | 206/806 X |
| 1,832,318 | 11/1931 | Myers | 40/334 |
| 1,996,983 | 4/1935 | Steinbach | 40/672 X |
| 2,084,971 | 6/1937 | Ghiselin | 40/672 X |
| 2,468,397 | 4/1949 | Goldstein . | |
| 2,487,419 | 11/1949 | Brooks . | |
| 2,578,548 | 12/1951 | Histed . | |
| 2,621,783 | 12/1952 | Buttery | 206/562 |
| 2,768,458 | 10/1956 | Anania . | |
| 2,811,796 | 11/1957 | Schoelles . | |
| 2,995,845 | 8/1961 | Fraser | 40/672 X |
| 3,266,687 | 8/1966 | Isoldi | 206/806 X |
| 4,142,310 | 3/1979 | Groselak et al. . | |
| 4,247,003 | 1/1981 | Jones | 206/486 |
| 4,432,452 | 2/1984 | Kelly | 206/354 |
| 4,598,489 | 7/1986 | Hoffman . | |
| 4,634,005 | 1/1987 | Kulzer et al. . | |
| 4,699,833 | 10/1987 | Instance . | |
| 5,390,434 | 2/1995 | Lockard . | |
| 5,537,765 | 7/1996 | Liebman et al. . | |
| 5,732,491 | 3/1998 | Burtch | 40/539 X |

OTHER PUBLICATIONS

Pyrex Accessories Label, Robinson Knife Company, Copyright 1996.

Cooks Club Label, Cooks Club, Inc., Copyright.

*Primary Examiner*—Brian K. Green

*Attorney, Agent, or Firm*—Wolf, Greenfield & Sacks, P.C.

[57] ABSTRACT

A single-sheet, multi-paneled product tag in which one panel that includes a channel for receiving the utensil is sandwiched between two other panels when the tag is folded. The channel for receiving the utensil is formed by a single U-shaped slot in one of the panels.

1 Claim, 3 Drawing Sheets

FOLDING PRODUCT TAG

FIELD OF THE INVENTION

The present invention generally relates to a product tag and, more specifically, to a single-sheet, multi-paneled, foldable product tag in which one panel includes a channel for receiving a utensil.

BACKGROUND OF THE INVENTION

In offering retail products for sale, product tags universally are used to provide advertising and product-related information to consumers. Such information may be useful to consumers in selecting a product for purchase. Typically, a product tag includes a paper or cardboard sheet on which written advertising and/or product-related information is listed. The tag is affixed either to the packaging of the product or directly to the product itself.

Consumers often desire directly viewing and handling products before making a purchase selection, particularly with products that require hand-held operation, such as kitchenware utensils. Many of those products, however, are offered for sale in fully-sealed packages and, thus, are not available for direct viewing and handling.

Some products are offered for sale without packaging, but with attached product tags, such that the products can be viewed and handled directly by consumers. The tags typically include separate attachment mechanisms, such as strings, staples, adhesive, etc., for attaching the tags to the products. Therefore, separate attachment mechanism hardware is required in manufacturing such tags. In addition, because of the nature of most attachment mechanisms, in order to remove the tags from the products, the attachment mechanisms must be severed, preventing reattachment of the tags and products. Thus, such tags typically have only a single use.

Product tags also exist that attach directly to products without requiring separate attachment mechanisms. Tags used with kitchenware utensils, for example, often attach directly to elongate portions (i.e., handles) of utensils. Such tags may suffer from a number of drawbacks such as weak product retention and/or poor aesthetic advertising presentation. Additionally, some of the tags have complex designs rendering them relatively difficult and/or costly to manufacture.

An exemplary direct-attachment prior art product tag is the Cooks Club® tag. The Cooks Club® tag is a single-sheet, double-paneled, foldable tag in which the panels surround the flat portion of a utensil (such as a flat-handled serving spoon), when the tag is folded. The panels are attached to one another with a tongue and slot attachment mechanism, integral with the panels. While the Cooks Club® tag is fairly simple in design, its use is limited to flat-handled utensils. In addition, absent being added by tape or other separate attachment mechanism, the tag easily can be removed from a utensil by sliding it along and off from the handle.

Another direct-attachment prior art tag is the Pyrex® tag, used on spatulas and the like. The Pyrex® tag is a single-sheet, three-paneled tag. The sheet is folded about a fold line that separates first and second of the three panels. Two slots in a third panel form a channel for receiving the elongate portion of the utensil.

The Pyrex® tag suffers from a number of drawbacks. For example, an enclosed region formed by the first and second panels hides at least part of the handle of the utensil. If a consumer wishes to view the handle, then either the tag must be removed from the utensil or the first and second panels must be detached. Once detached, however, the first and second panels cannot easily be reattached because adhesive is used to attach the panels to one another. Also, the two-slot channel design is fairly complex. Further, the advertising presentation and aesthetic appearance of the tag is somewhat compromised due to the centrally-located and directly visible channel within the third panel.

It accordingly is a general object of the present invention to provide a product tag that is simple in design, and yet offers re-use, good product retention, and aesthetically pleasing advertising presentation.

SUMMARY OF THE INVENTION

One embodiment of the invention is directed to a single-sheet, multi-paneled product tag in which one panel that includes a channel for receiving a utensil is sandwiched between two other panels when the tag is folded.

In this embodiment, the tag includes a single sheet having first, second and third panels. The first and second panels are separated by a first fold line, and the second and third panels are separated by a second fold line. Each of the first and second panels has an advertising face upon which written information may be listed. Means, integral with the panels, is included for releasably securing one panel to another with the sheet folded along the first and second fold lines. When folded, the advertising faces of the first and second panels are oriented outwardly and the third panel is sandwiched between the first and second panels. An aperture is located within the third panel for forming a channel through which an elongate portion of the product is inserted such that the sheet surrounds the elongate portion and is retained thereon.

In an embodiment, the means for releasably securing one panel to another panel includes a tongue formed within the one panel and an aperture formed within the another panel into which the tongue is inserted.

In an embodiment, the elongate portion of the utensil extends approximately parallel to the fold lines.

Another embodiment of the invention is directed to a multi-paneled product tag in which the channel for receiving the utensil is formed by a single substantially U-shaped slot in one of the panels.

In this embodiment, the product tag includes a single sheet having at least first and second panels separated by a fold line. The panels are releasably attached to one another. A channel that receives an elongate portion of a utensil is formed by a single substantially U-shaped slot in one of the panels.

In an embodiment, the elongate portion of the utensil extends approximately parallel to the fold line.

In an embodiment, the channel is formed within a third panel which is sandwiched between the first and second panels.

In an embodiment, a tongue and slot attachment mechanism is included for releasably securing the first panel to the second panel.

In an embodiment, the third panel has a length in at least one dimension less than that of at least one of the first and second panels.

DETAILED DESCRIPTION

The product tag of the invention includes a single-sheet, multi-paneled tag that folds about fold lines separating the panels. Two of the panels are releasably attached to one another with an attachment mechanism integral with the sheet. A channel for receiving the elongate portion of a utensil is formed within one of the panels that is sandwiched between two other panels when the tag is folded. The tag offers the advantages of compactness, good product retention, reusability, and aesthetically pleasing advertising presentation.

Figure 1:
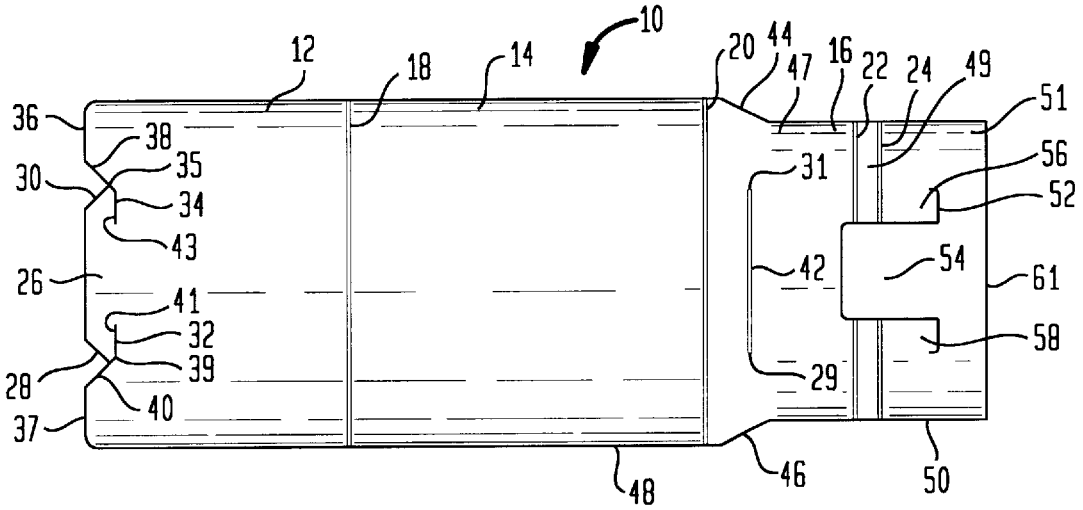
FIG. 1 shows a view of one side of the product tag of the invention in its fully unfolded and extended position.

Shown in FIG. 1 is a view of one side of the product tag 10 of the invention in its fully extended, unfolded position. In this exemplary embodiment, the tag includes a single sheet with three panels 12, 14 and 16. Panels 12 and 14 are separated by a fold line 18. Panels 14 and 16 are separated by a fold line 20. As will be described in greater detail below, the panels fold about fold lines 18 and 20.

When folded, panel 12 is releasably attached to panel 16. A tongue 26 is formed within panel 12 and a slot 42 is formed within panel 16. When folded, tongue 26 is inserted within slot 42 for releasably attaching the panels to one another. While tongue 26 is shown formed as part of panel 12 and slot 42 is shown formed within panel 16, the tongue and slot may be formed in other panels. Other attachment mechanisms alternatively may be used.

Tongue 26 includes tapered edges 28 and 30 which extend respectively toward tapered edges 40 and 38 of panel 12. Triangular-shaped cutouts are defined by tapered edges 38 and 30 and tapered edges 40 and 28. Slits 32 and 34 are formed within panel 12 and respectively extend from the tips 39 and 35 of the triangular-shaped cutouts inwardly toward one another within panel 12, offering flexibility in movement to tongue 26 and for aiding in the retention of tongue 26 within slot 42. The distance between the tips 35 and 39 of the triangular-shaped cutouts and the length of slot 42 are approximately equal such that when tongue 26 is inserted within slot 42, edges 41 and 43 of tongue 26 respectively will contact walls 29 and 31 of panel 16 on either side of slot 42 to retain tongue 26 within slot 42. Due to the flexibility of tongue 26 and its fit within slot 42, tongue 26 can be removed from slot 42, thus offering releasable attachment of the panels and reuse of the tag. Flat edges 36 and 37 are located outwardly of the triangular-shaped cutouts along the edge of panel 12.

Panel 16 includes two fold lines 22 and 24 that extend approximately parallel to one another. As will be explained in greater detail below, third panel 16 is folded about lines 22 and 24. Fold lines 22 and 24 in panel 16 essentially divide panel 16 into three sections 47, 49 and 51. Third panel also includes a single, substantially U-shaped slot 52 for forming a channel that receives the elongate portion of a utensil. The channel formed includes a lip 54 which aids in retaining the utensil within the channel. Formed on either side of slot 52 of the channel are shoulder sections 56 and 58.

In this embodiment, third panel 16 includes side edges that taper inwardly at tapers 44 and 46 from the side edges of adjacent panel 14 such that panel 16 is smaller in length, in the dimension defined by the direction parallel to the fold lines, than is that of the other two panels 12 and 14. This smaller dimension aids in hiding the third panel from the view of a consumer when the tag is in its fully folded position.

Figure 2:
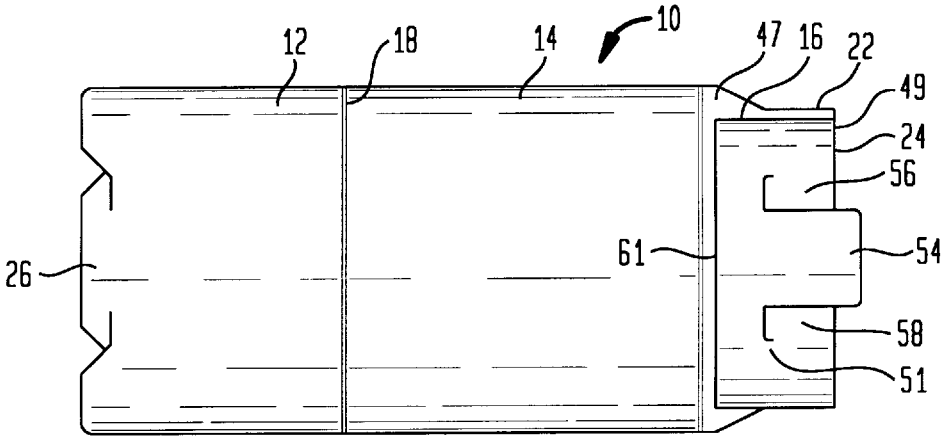
FIG. 2 shows a view of one side of the product tag in a first partially folded position during a first stage of folding.

FIG. 2 shows a view of one side of tag 10 in a first partially folded position during a first stage of folding. As shown, panel 16 is folded about fold lines 22 and 24 such that edge 61 of panel 16 extends towards panel 12 and section 51 extends substantially parallel to section 47 and substantially perpendicular to section 49. Also, lip 54 of the channel extends in a direction away from panel 14.

Figure 3:
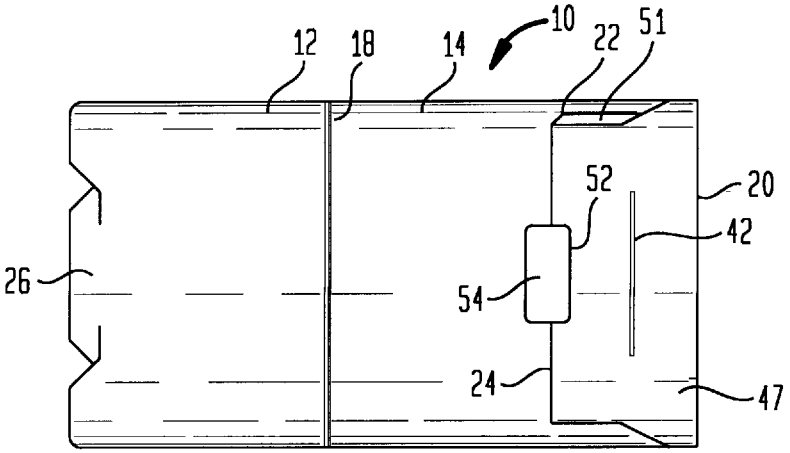
FIG. 3 shows a view of one side of the product tag in a second partially folded stage during a second stage of folding.

FIG. 3 shows a view of one side of the tag in a second, more fully folded position than that shown in FIG. 2. As shown, tag 10 additionally is folded along fold line 20 such that panel 16 is folded towards panel 12 and sections 47 and 51 of panel 16 extend approximately parallel to panel 14. Lip 54 of the channel now extends in a direction toward panel 12.

Figure 4:
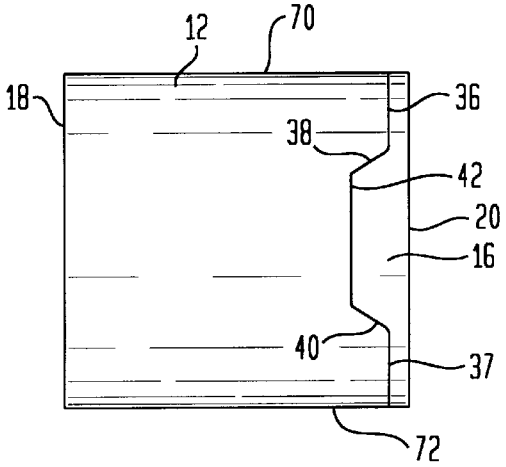
FIG. 4 shows a view of one side of the product tag in its fully folded position.

FIG. 4 is a view of one side of the tag in its fully folded position. The view is that of the outer side of panel 12. From the position shown in FIG. 3, the tag is folded about fold line 18 such that panel 12 is folded towards panel 16 and tongue 26 is inserted within slot 42 for releasably retaining panel 12 to panel 16. From the views of FIGS. 4 and 5, with the tag in its fully folded position, panel 16 is completely hidden from view by panels 12 and 14. Note, however, that the tag is open at sides 70 and 72 and panel 16 may be visible between panels 12 and 14 by viewing the folded tag in the direction of those sides.

Figure 5:
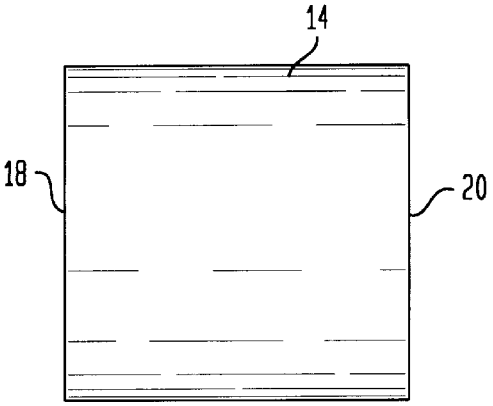
FIG. 5 shows a view of another side of the product tag in its fully folded position.

Shown in FIG. 5 is a view of the opposite side of the tag (to that of FIG. 4) when it is in its fully folded position. The side shown is that of the outer side of panel 14. Each of the outer side faces of panels 12 and 14 may have advertising material and/or product-related information listed thereon. The outer side faces of panels 12 and 14, when the tag is folded, are unobstructed by the product providing full faces on which material may be listed. In this embodiment, the tag is approximately square in shape. It should be appreciated, however, that tags of other shapes, such as rectangular or those with rounded edges, are envisioned.

As will be described in more detail below, a portion of the product to which the tag is attached is retained within the channel of panel 16 of the tag. As shown and described, when the tag is in its fully folded position, panel 16, including the retaining channel formed within panel 16, is hidden from view when the tag is viewed in the direction of either of panels 12 and 14. This arrangement adds to the aesthetic advertising presentation of the tag.

Figure 6:
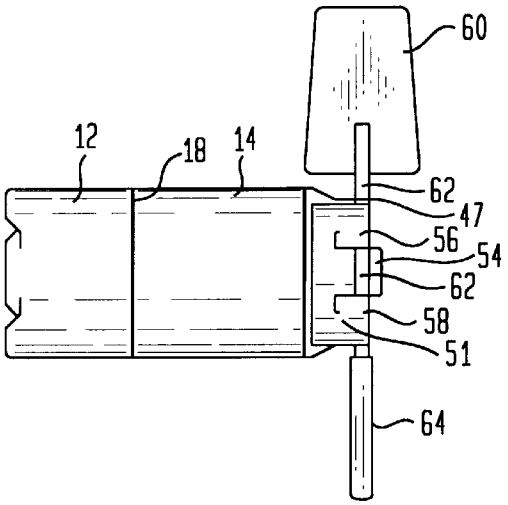
FIG. 6 shows a view of one side of the product tag in the first partially folded position during attachment to a utensil.

FIG. 6 shows a view of one side of the tag in the first partially folded position in which the tag is being attached to a spatula 60. The position shown in FIG. 6 is the same as that shown in FIG. 2. While it is shown being attached to a spatula 60, it should be understood that the tag of the present invention can be attached to any product having an elongate portion such as a handle. Spatula 60 includes an elongate portion 62 that extends into a handle 64.

Panel 16 of the tag is folded about fold lines 22 and 24. Elongate portion 62 of spatula 60 is inserted within the channel, handle-side first, such that it extends (from the orientation of the view shown in FIG. 6) beneath shoulders 56 and 58 but above lip 54. In other words, elongate portion 62 extends between shoulders 56 and 58 and section 47 of panel 16, and outwardly of lip 54. Lip 54 acts to bias elongate portion 62 of spatula 60 against shoulders 56 and 58, thereby retaining spatula 60 within the channel of the third panel. The utensil, however, is releasable from the channel by sliding it out from the channel in the direction away from the handle.

Figure 7:
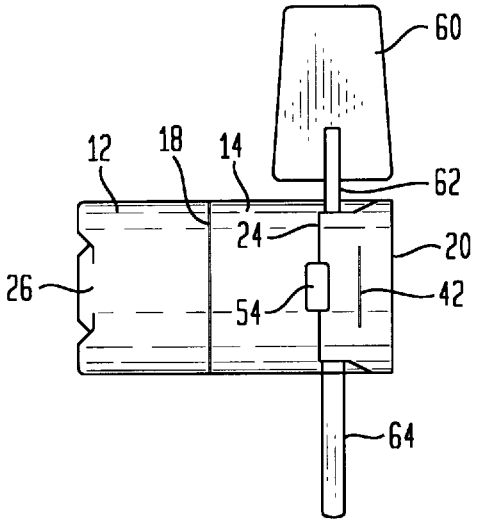
FIG. 7 shows a view of the product tag in the second partially folded position during attachment to the utensil.

FIG. 7 shows a view of one side of the tag being attached to spatula 60 in a second more fully folded position. The tag is additionally folded about fold line 20, with the spatula still being retained within the channel as shown in FIG. 6. The position shown in FIG. 7 is the same as that shown in FIG. 3.

Figure 8:
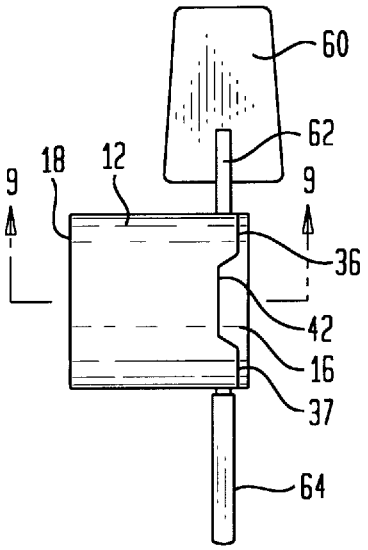
FIG. 8 shows a view of the product tag in its fully folded position attached to the utensil.

FIG. 8 shows a view of one side of the tag in its fully folded position and attached to spatula 60. The view shown is the same as that shown in FIG. 4. As shown, tongue 26 is inserted within slot 42 to releasably attach the panels to one another with the tag in its fully folded position. Outwardly oriented face of panel 12 shown in FIG. 8 and outwardly oriented face of panel 14 (shown in FIG. 5) may include advertising and/or product-related information listed thereon. As shown, third panel 16, that includes the channel for retaining the tag to the spatula, is not visible in the view shown in FIG. 8, thus aiding in the aesthetic appearance of the tag.

Figure 9:
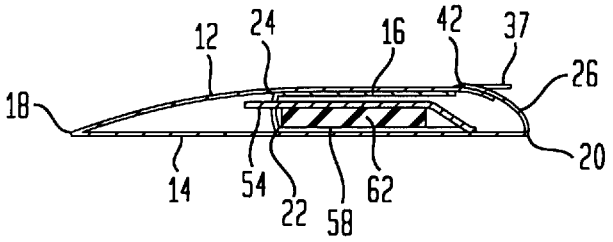
FIG. 9 is a cross-sectional view of the product tag taken along lines 9—9 of FIG. 8 showing the product tag attached to the utensil.

FIG. 9 shows a cross-sectional view of the tag as attached to spatula 60 along lines 9—9 of FIG. 8. As shown, the tag is in its fully folded position being folded along fold lines 18, 20, 22 and 24. Additionally, tongue 26 is inserted within slot 42. Elongate portion 62 is shown in cross-section retained within the channel between tongue 54 and shoulder 58, with tongue 54 biasing elongate portion 52 against shoulder 58.

In one embodiment, the tag is formed from cardboard. Other materials, however, may be suitable for a particular application. In one embodiment, the tag has a total length in its unfolded, fully extended position (shown in FIG. 1) of 7¾ inches with the first panel being approximately 2⅝ inches in length, the second panel being approximately 2¾ inches in length, and the third panel being approximately 2⅜ inches in length. In one embodiment, the first and second panels have a width of approximately 3 inches and the third panel has a width of approximately 2⅝ inches in the direction of the fold lines. Also, in one embodiment, lip 54 has a length of approximately 1 inch and slot 42 has a length of approximately 1½ inches. These dimensions can be altered depending on the size of the utensils to which the tag is being attached.

Having now described the preferred embodiment of the invention, it should be apparent to those skilled in the art that the foregoing is illustrative only and not limiting, having been presented by way of example only. Numerous other embodiments and modifications thereof are contemplated as falling within the scope of the present invention as defined by appended claims and equivalents thereto.

What is claimed is:

1. A tag and a utensil comprising:

a single sheet including at least first, second and third panels, the first and second panels separated by a first fold line and the second and third panels separated by a second fold line, the third panel having multiple fold lines, a channel formed by the third panel, wherein when the tag is folded along the first and second fold lines, and the third panel is folded on itself along the multiple fold lines, the third panel is located directly between the first and second panels;

the utensil including an elongate portion received within the channel such that the tag is retained on the utensil; and wherein the channel is formed such that the elongate portion of the utensil extends approximately parallel to the first and second fold lines.

* * * * *